US005931530A

United States Patent [19]

Liu

[11] Patent Number: 5,931,530

[45] Date of Patent: Aug. 3, 1999

[54] ROTARY ROCKING CHAIR

[76] Inventor: Lausan Chung Hsin Liu, No. 243, Chien-Kuo Rd., Hsin-Tien, Taiwan

[21] Appl. No.: 09/113,366

[22] Filed: Jul. 10, 1998

[51] Int. Cl.[6] ..... A47C 3/02

[52] U.S. Cl. ..... 297/270.3; 297/344.21

[58] Field of Search ..... 297/270.1, 270.3, 297/258.1, 259.3, 344.21, 344.24, 344.26, 263.1

[56] References Cited

U.S. PATENT DOCUMENTS 4,893,871 1/1990 Kowalski ..... 297/270.1
5,344,214 9/1994 Trent ..... 297/270.3 X
5,427,433 6/1995 Holobaugh, Jr. ..... 297/258.1 X
5,558,397 9/1996 Chang ..... 297/258.1 X
5,599,064 2/1997 Vanderminden, Sr. ..... 297/258.1 X

*Primary Examiner*—Milton Nelson, Jr.
*Attorney, Agent, or Firm*—Bacon & Thomas, PLLC

[57] ABSTRACT

A rocking chair comprising a chair seat, a base and a rocking mechanism connecting the chair seat and the base, the rocking mechanism being inserted in the shaft sleeve installed on the upper part of the base, so the chair seat may rotate as opposed to the base. The rocking mechanism will cause the chair seat to produce a front and rear rocking movement, and restrict its rocking dislocation.

3 Claims, 3 Drawing Sheets

ROTARY ROCKING CHAIR

BACKGROUND OF THE INVENTION a. Technical field

The invention relates to a type of rotary rocking chair, and particularly to one with concurrent rotation and rocking functions.

b. Prior art

The use of chairs is closely related to the daily lives of the general. Since a chair provides proper support to a human body, it is an essential appliance in daily living. For the purpose of providing the most comfortable effects to human bodies, we have seen the development of chair sets with various functions.

Conventionally, a rocking chair has an arched rocking stand, when the user sits on it and apply a force, the arched rocking stand will rock to and fro, so the main unit of the rocking chair rocks accordingly. However, since the rocking stand of said rocking chair is arched, it is in contact with the floor on a single spot, and since there is no limit for the rocking arc (or the strength of applying force), when it is used on an uneven floor surface or a larger force is applied, it will be overturned because of unstable center of gravity, so there is the worry of its safety.

Besides, a regular rocking chair has its emphasis either on a rocking or a rotary function, there is rarely a combination of the two, therefore, when the user operates such a chair with either a rotary or a rocking function, there will be a one-way movement. For example, in case the user is using a rocking chair with only a rocking function, it will provide the user with the movement of body to the front and back; in case a user is using a rotary chair with only a rotary function, it will produce body movement to the left and right.

OBJECTIVES OF THE INVENTION

Therefore, to solve the above shortcomings in conventional types, the inventor has developed a rotary rocking chair, with primary objective to provide a type of rotary rocking chair with concurrent rotary and rocking functions, when the user uses the invention, he may freely choose front-and-back or left-and-right bodily movement, to achieve an optimum effect providing the best comfort to a human body.

Another objective of the invention is to provide a rotary rocking chair that is easily produced at a low cost. The invention involves simple mechanical construction to produce steady rotary or rocking movement, so the user will not be overturned due to unstable center of gravity.

Another objective of the invention is to provide a rotary rocking chair involving limit parts, said limit parts are designed to restrict the rocking distance of the chair seat, to enhance operational safety of the invention.

The technical contents of the invention are described with drawings as follows.

DETAILED DESCRIPTION OF PREFERRED EMBODIMENT

Figure 1:
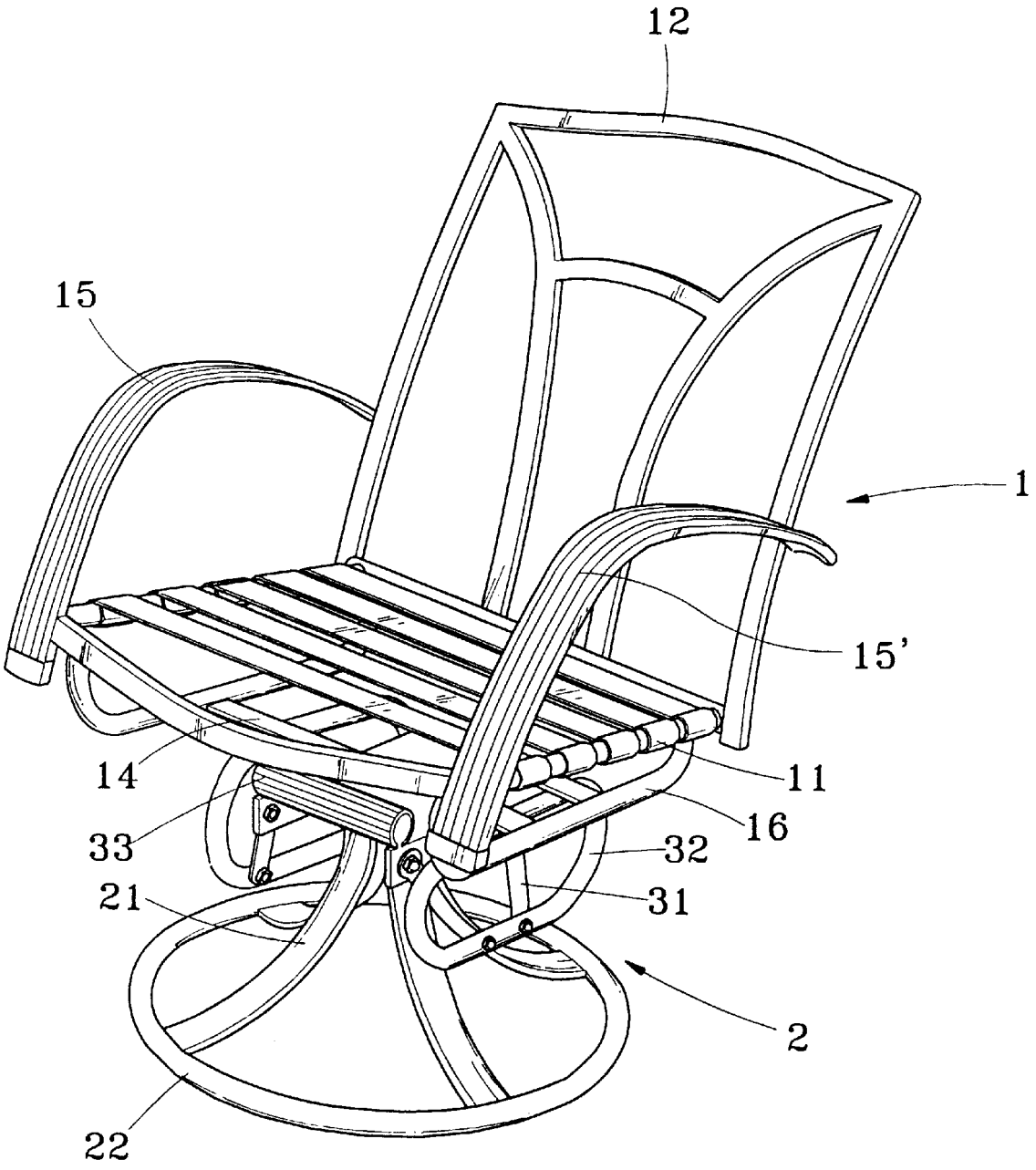
FIG. 1 is a perspective assembled view of the invention.

Please refer to FIG. 1, the invention relates to a type of rotary rocking chair, comprising a chair seat(1), a base(2) and a rocking mechanism(3) connecting the chair seat(1) and the base(2).

The chair seat(1) comprises a seat part(11), a back(12) providing support to the back of the user, and a pair of arm rests(15,15') provide support for the arms of the user. At the left and right sides of the bottom of the seat part(1) is respectively a side bar(16), the two side bars(16) are connected vertically by means of no less than one cross bar(14).

Figure 2:
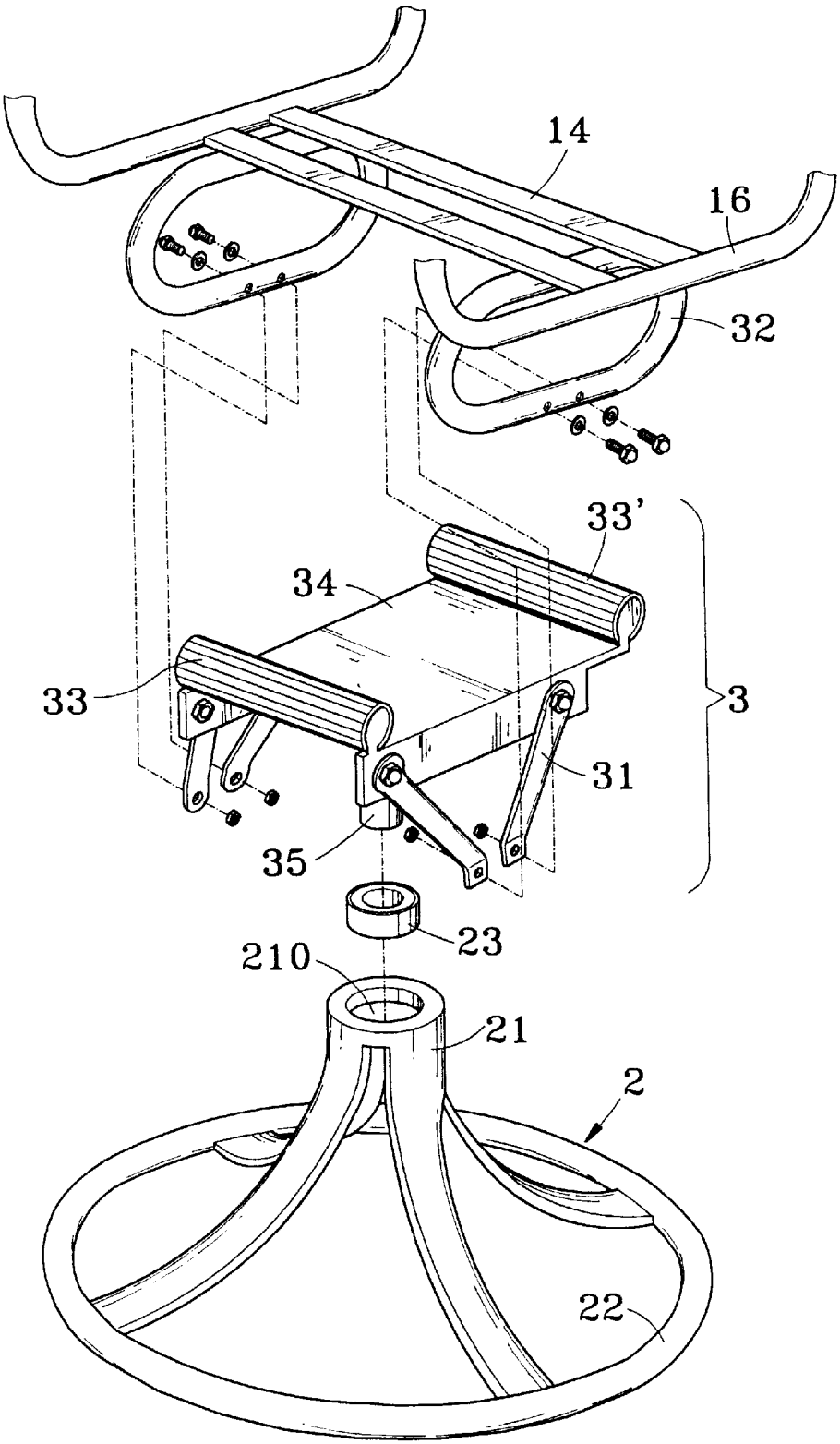
FIG. 2 is a partially exploded view of the invention, illustrating the connection between a rocking mechanism and a base.

Please refer again to FIG. 2, the rocking mechanism(3) claimed by the invention comprises a slide platform(34) located between the cross bar(14) and the base(2), the two sides of said slide platform(34) are connected to no less than one rocking branch(31), the connection is made by screwing a free end of the rocking branch(31) to one side of the slide platform(34) to the effect that it will be able to rotate, so said end of the rocking branch(31) serves as the center of rotation for free rotation. The other end of the rocking branch(31) is screwed to a transmission part(32). To drive the chair seat(1) and the rocking branch(31) to rock simultaneously, one side of the transmission part(32) is joined to the cross bar(14) of the chair seat(1), therefore, when the user is sitting on the seat part(11) and a force is applied, the rocking branch(31) will rely on the end of the fixed slide platform as a center of rotation, and drive the cross bar(14) via the transmission part(32), and indirectly drive the chair seat(1) to rock to and fro on the slide platform(34).

The center of the bottom of said slide platform(34) is welded or screwed with a support shaft(35), said support shaft(35) is inserted in the shaft sleeve(23) of the base(2). There is an appropriate clearance between said support shaft(35) and the shaft sleeve(23) for lubrication purpose, so the slide platform(34) may rotate freely in relation to the base(2), without causing any interference. Said shaft sleeve (23) can be a regular ball bearing or roller bearing, or a properly lubricated sleeve.

Figure 3B:
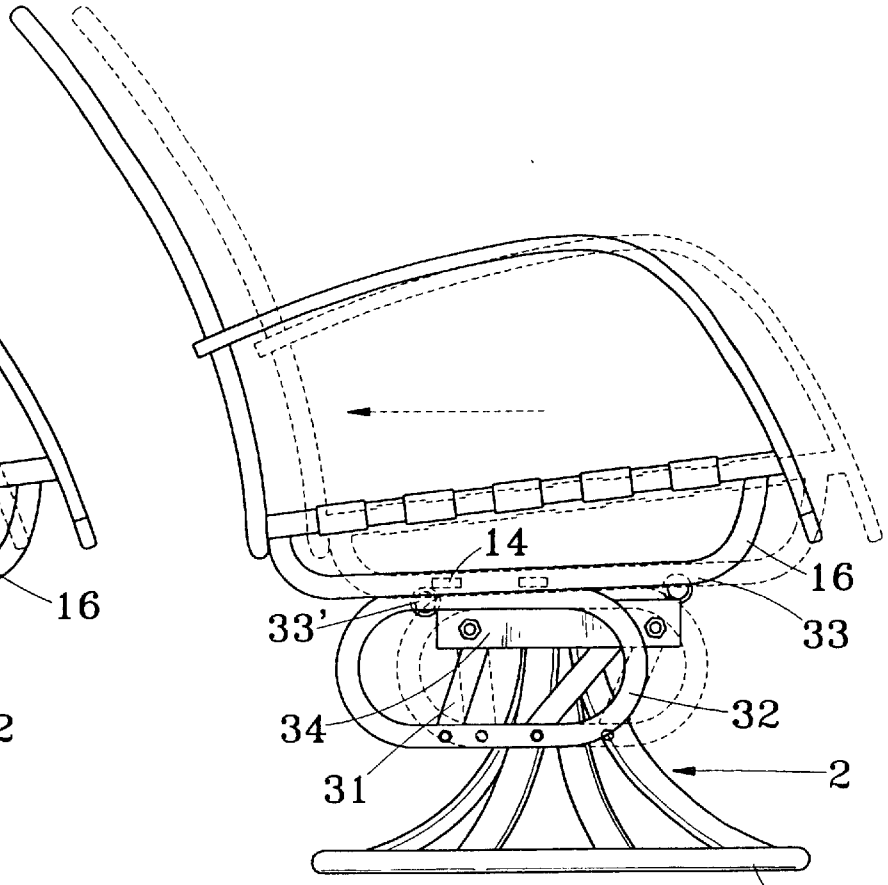
FIG. 3B illustrate a rear-limit part in the invention, where the chair movement is stopped.
Figure 3A:
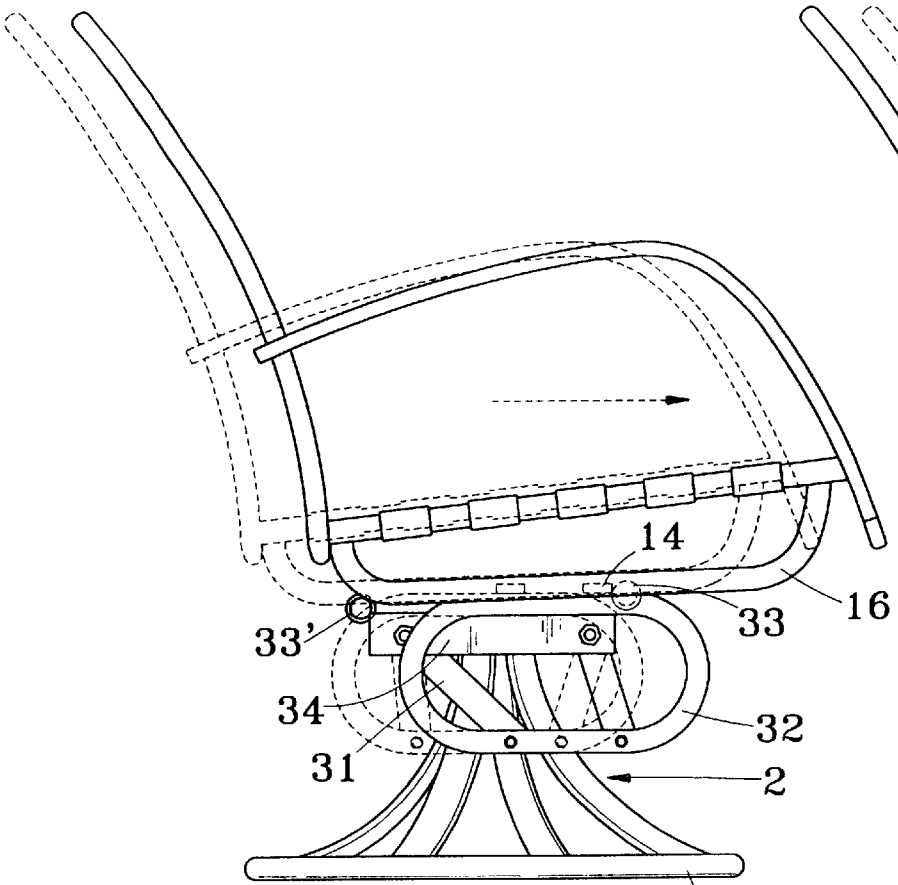
FIG. 3A illustrates a front-limit part in the invention, where the chair movement is stopped.

Furthermore, at the front and rear limits of said slide platform(34) are fixed a front limit part(33) and a rear limit part(33'), to restrict the back and forth movement of the cross bar(14) and prevents its dislocation from platform (34). When the cross bar(14) advances to the front limit, the front limit part(33) at the front of the chair seat(1) will disable further advancement of the cross bar(14) (FIG. 3A); conversely, when the cross bar(14) retreats to the rear limit, the rear limit part(33') at the rear of the chair seat(1) will stop the cross bar(14) from further retreat (see FIG. 3B), therefore, the rocking distance of the chair seat(1) will be restricted, so the user will not be overturned by an excessive rocking arc. Furthermore, to absorb the vibration energy produced when the cross bar(14) is impacting the front and rear limit parts(33,33'), and avoid the feeling of instability to the user, there is a rubber coating on the outside of the front and rear limit parts(33,33').

The base(2) of the invention comprises a chair shaft(210), on its upper end is an opening(21) to 20 accommodate the shaft sleeve(23) and the insertion of a support shaft(35) of the slide platform(34) to fix it. In addition, to reinforce the stability of the invention in application, at the bottom of said base(2) may be an additional bottom plate(22) in contact with the floor, to increase the contacting area with the floor, so the chair seat(1) will be quite stable in its rotation or rocking process.

The above description covers only an embodiment of the invention, so it shall not be based to restrict the claims of the invention, and that all modifications deriving from the intent of the invention shall be included in the subject claims.

What I claim is:

1. A rotary rocking chair comprising:

a) a chair seat having a bottom portion, a pair of side bars extending downwardly from the bottom portion, a cross bar connecting the side bars, a pair of transmission units extending downwardly from the cross bar;

b) a base, an opening formed at an upper end of the base, a shaft sleeve disposed within the opening;

c) a rocking mechanism disposed between the chair seat and the base, the rocking mechanism including a slide platform, a support shaft extending from a bottom of the slide platform and received within the shaft sleeve to permit the slide platform to rotate with respect to the base;

d) a pair of rocking branches, each rocking branch including a pair of ends, one end of each rocking branch being rotatably secured to a side of the slide platform and the other end of each rocking branch being secured to a transmission unit; and e) the slide platform further including a front end and a rear end, a limit part provided at each of the front and rear ends for limiting the travel of the cross bar and preventing dislocation of the cross bar from the slide platform.

2. The rocking chair of claim 1, wherein each of the limit parts includes an exterior rubber coating.

3. The rocking chair of claim 1, wherein the base further includes a plate at a bottom thereof for increasing surface area contact and friction between the base and a floor surface to enhance stability of the chair.

* * * * *